US008062436B2

(12) United States Patent
Branagan et al.

(10) Patent No.: US 8,062,436 B2
(45) Date of Patent: Nov. 22, 2011

(54) TENSILE ELONGATION OF NEAR METALLIC GLASS ALLOYS

(75) Inventors: Daniel James Branagan, Idaho Falls, ID (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 243 days.

(21) Appl. No.: 12/268,230

(22) Filed: Nov. 10, 2008

(65) Prior Publication Data

US 2009/0120537 A1 May 14, 2009

Related U.S. Application Data

(60) Provisional application No. 60/986,863, filed on Nov. 9, 2001.

(51) Int. Cl.
*C22C 45/02* (2006.01)

(52) U.S. Cl. ..... 148/403; 420/12; 420/64

(58) Field of Classification Search ..... None
See application file for complete search history.

(56) References Cited

U.S. PATENT DOCUMENTS

| | | | | |
|---|---|---|---|---|
| 4,365,994 | A | 12/1982 | Ray | |
| 4,473,401 | A * | 9/1984 | Masumoto et al. | 148/403 |
| 6,689,234 | B2 * | 2/2004 | Branagan | 148/660 |
| 7,052,561 | B2 * | 5/2006 | Lu et al. | 148/403 |
| 2005/0164016 | A1 | 7/2005 | Branagan et al. | |
| 2006/0180252 | A1 | 8/2006 | Branagan et al. | |
| 2011/0165348 | A1 * | 7/2011 | Farmer et al. | 427/580 |

OTHER PUBLICATIONS

Branagan, D.J. et al., "High Toughness High Hardness Iron Based PTAW Weld Materials", Materials Science and Engineering A, vol. 428, pp. 116-123, Jul. 2006.*

International Search Report and Written Opinion dated Jan. 6, 2009 issued in related International Patent Application No. PCT/US08/83029.

* cited by examiner

*Primary Examiner* — George Wyszomierski

(74) *Attorney, Agent, or Firm* — Grossman, Tucker, Perreault & Pfleger, PLLC

(57) ABSTRACT

The present disclosure relates to a near metallic glass based alloy wherein the alloy includes at least 40 atomic percent iron, greater than 10 atomic percent of at least one or more metalloids, and less than 50 atomic percent of at least two or more transition metals, wherein one of said transition metals is Mo said alloy exhibits a tensile strength of 2400 MPa or greater and an elongation of greater than 2%.

7 Claims, 7 Drawing Sheets

TENSILE ELONGATION OF NEAR METALLIC GLASS ALLOYS

CROSS REFERENCE TO RELATED APPLICATIONS

The present application claims the benefit of the filing date of U.S. Provisional Application Ser. No. 60/986,863, filed Nov. 9, 2007, the teachings of which are incorporated herein by reference.

FIELD

The present disclosure relates to a near metallic glass alloy exhibiting relatively high tensile elongation.

BACKGROUND

Metallic glasses may not exhibit any significant tensile elongation due to inhomogeneous shear banding, which may be understood as a relatively narrow layer of intense shear in a solid material. Metallic glasses tested in tension may show relatively high strength, relatively little plasticity (brittle fracture in elastic region), and a high degree of scattering in tensile elongation data due to the presence of flaws in metallic glasses that may lead to catastrophic failure.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

SUMMARY

Figure 1:
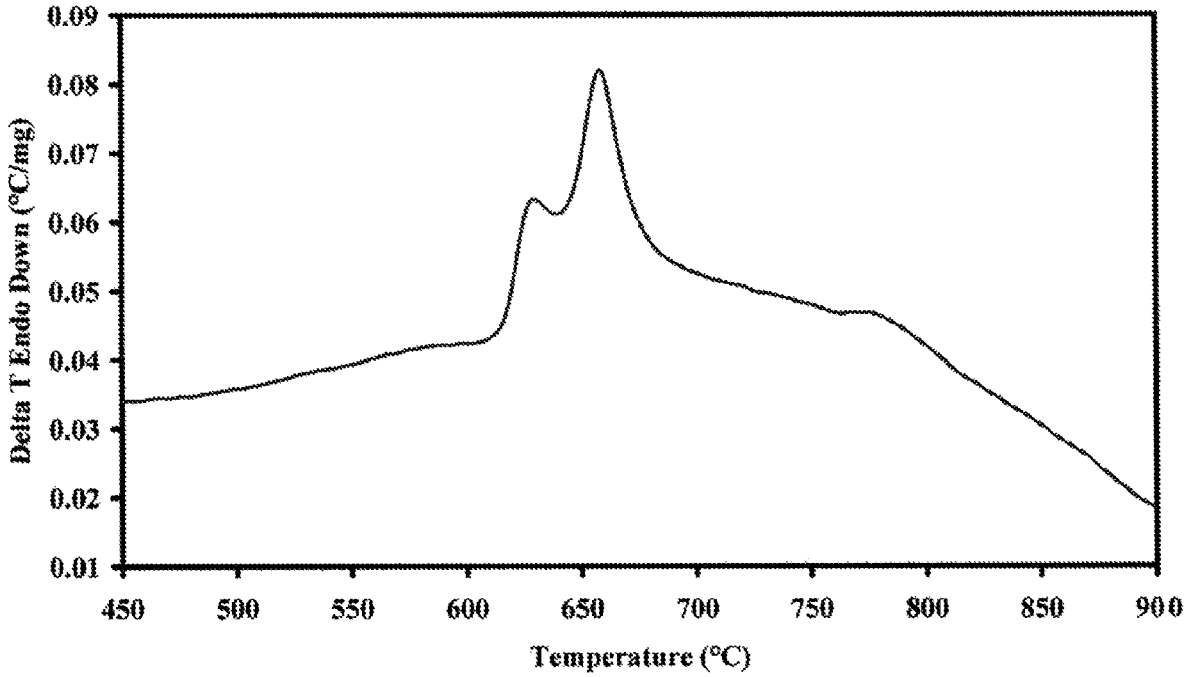
FIG. 1 DTA scan showing glass to crystalline peak for SHS 7570 alloy.

The present disclosure is directed to a near metallic glass based alloy, comprising an alloy including at least 40 atomic percent iron, greater than 10 atomic percent of at least one or more metalloids and less than 50 atomic percent of at least two or more transition metals, wherein one of said transition metals is Mo and said alloy exhibits a tensile strength of 2400 MPa or greater and an elongation of greater than 2%.

DETAILED DESCRIPTION

The present disclosure contemplates an iron near metallic glass alloy, wherein the alloy may exhibit relatively high tensile strength and elongation. A near metallic glass alloy may be understood as a metallic glass alloy, which may include crystalline structures or relatively ordered atomic associations on the order of less than 100 Mm in size, including all values and increments in the range of 0.1 nm to 100 Mm, 0.1 nm to 1 μm, etc. In addition, the alloy may be at least 40% metallic glass, wherein crystalline structures or relatively ordered atomic associations may be present in the range of 0.1 up to 60% by volume of the volume of the alloy. Such crystalline structures may include various precipitates in the alloy composition.

In one example, the alloy may include at least 40 atomic percent iron, greater than 10 atomic percent of at least one or more metalloid, and less than 50 atomic percent of at least two or more transition metals, wherein one of the transition metals is Mo. The tensile strength exhibited by the alloy may be 2400 MPa or greater and the percent elongation of the alloy may be greater than 2% and up to 8%.

In another example, the alloy may include two or more transition metals, wherein one of the transition metals is Mo and the other transition metals may be selected from the group consisting of Cr, W, Mn or combinations thereof. In addition, the alloy may include metalloids selected from group consisting of B, Si, C or combinations thereof. Furthermore, the alloy may include or consist of Cr present at less than 25 atomic %, Mo present at less than 15 atomic %, W present at less than 5 atomic %, Mn present at less than 5 atomic %, B present at less than 25 atomic %, Si present at less than 5 atomic %, and/or C present at less than 5 atomic % and the balance may be Fe.

In another example, the alloy may include or consist of Fe present in the range of 48 to 52 atomic %, Mn present in the range of 0.1 to 3.0 atomic %, Cr present in the range of 17 to 20 atomic %, Mo present in the range of 5 to 7 atomic %, W present in the range of 1 to 3 atomic %, B present in the range of 14 to 17 atomic %, C present in the range of 3 to 5 atomic percent and/or Si present in the range of 1 to 4 atomic %, including all values and increments in the ranges described above. Furthermore, it should be appreciated that the alloy formulations may be non-stoichiometric, i.e., the formulations may include increments in the range of 0.001 to 0.1. For example, the alloy may include an alloy having the following stoichiometry $Fe_{50.8}Mn_{1.9}Cr_{18.4}Mo_{5.4}W_{1.7}B_{15.5}C_{3.9}Si_{2.4}$.

The alloys may exhibit crystallization transformations as measured by DTA at a rate of 10° C./minute of greater than 625° C., including all values and increments in the range of 625° C. to 800° C. In addition, the alloys may exhibit multiple peak crystallization transformations at temperatures of greater than 625° C., including all values and increments in the range of 625° C. to 800° C. A crystallization transformation peak may be understood as a maximum point in the exothermic crystallization event, or a crystallization exotherm, at an indicated temperature in the DTA analysis. Over such range of temperatures, two or more exothermic crystallization peaks may be exhibited, such as three peaks, four peaks, five peaks, etc. Furthermore, the alloys may exhibit an elongation of greater than 2%, including all values and increments therein, such as in the range of greater than 2% to 8%, when measured at a rate of $1\times10^{-3}s^{-1}$. Elongation may be understood as a percentage increase in length prior to breakage under tension. The alloys may also exhibit a tensile strength of greater than 2400 MPa, when measured at a rate of $1\times10^{-3}s^{-1}$, including all values and increments therein such as in the range of 2400 MPa to 2850 MPa. Tensile strength may be understood as the stress at which a material breaks or permanently deforms.

Without being limited to any particular theory, it is possible that crystalline precipitates may exist in the glass matrix. It is also believed that two distinct types of molecular associations may be forming in the glass and the interaction between these distinct associations may somehow allow for metallic slip through homogeneous deformation or some other unknown mechanism.

Example 1

An example of an alloy contemplated herein may include SHS7570, available from NanoSteel Corporation, Providence, R.I. The alloy had the following atomic stoichiometry:

$Fe_{50.8}Mn_{1.9}Cr_{18.4}Mo_{5.4}W_{1.7}B_{15.5}C_{3.9}Si_{2.4}$.

A DTA scan of the ribbon tested show that it exists primarily in a metallic glass state as shown in FIG. 1. The glass to crystalline transformation peaks are shown with peak temperatures at 631° C., 659° C., and 778° C., when measured at 10° C./min. It may be appreciated that these peak temperatures may occur within +/−5° C. of the indicated temperatures, e.g., the initial peak may be observed at temperatures of 626° C. to 636° C.

Figure 2:
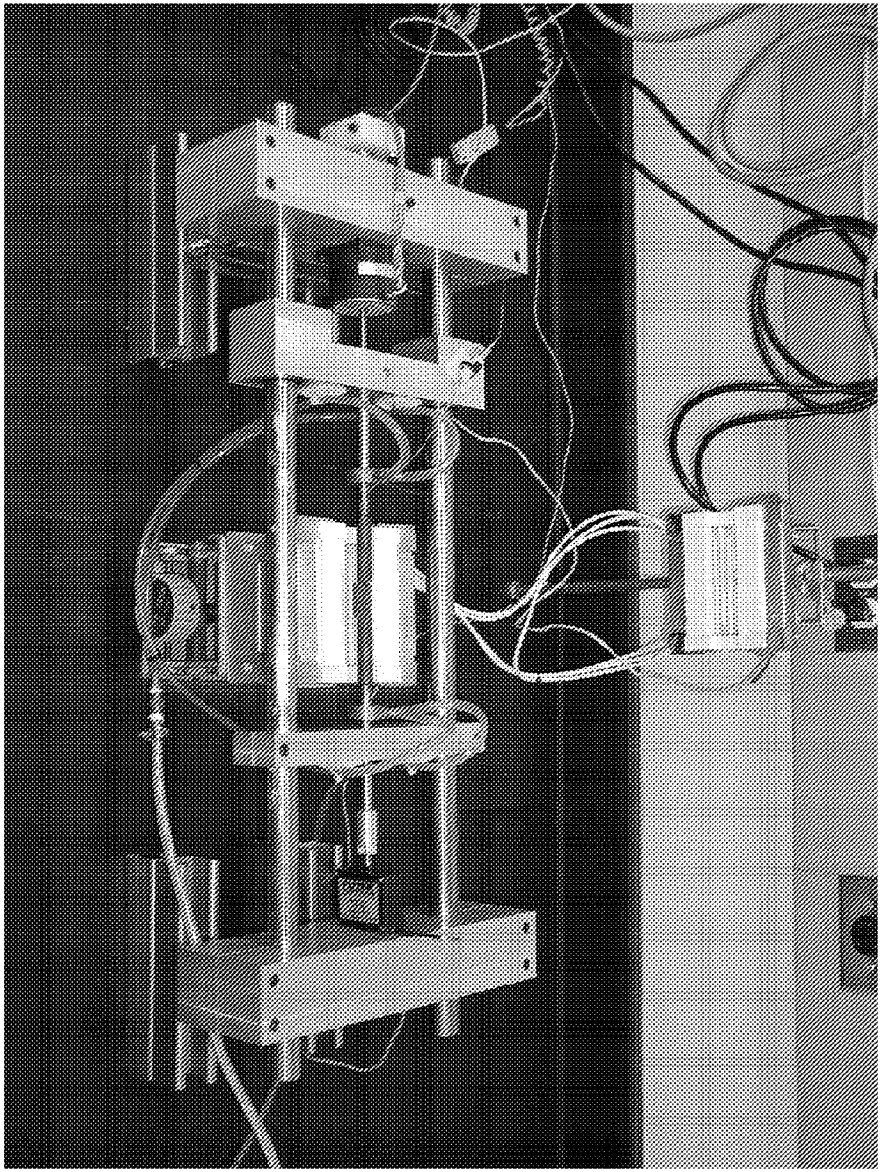
FIG. 2 Custom-built mini tensile tester designed to test subsize tensile speciments
Figure 3:
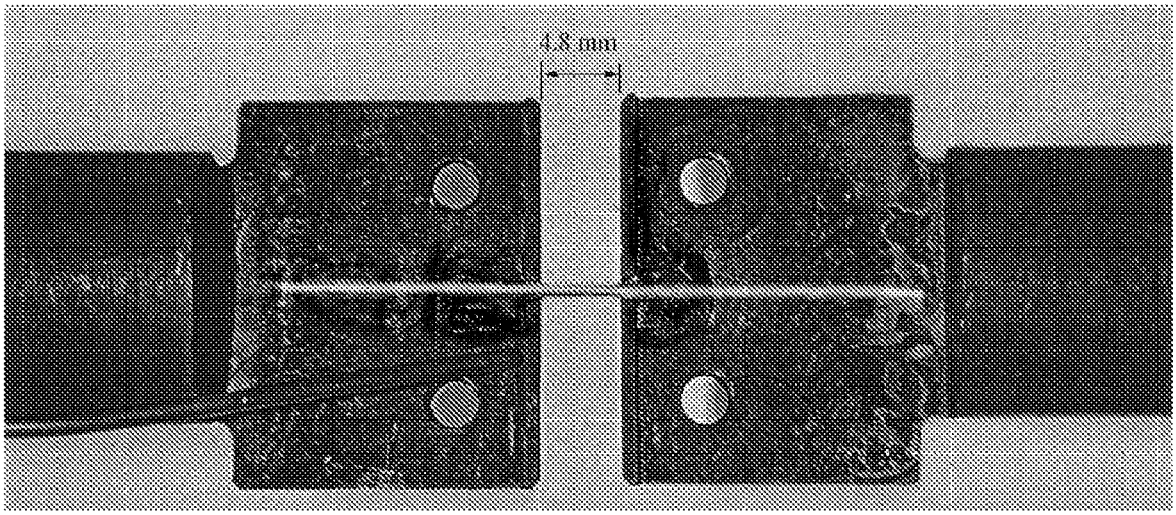
FIG. 3 illustrates flat grips holding the as spun ribbon alloy of SHS7570.

Tensile testing was performed using a LabView controlled custom-built mini tensile tester with displacement resolution of 5 microns and load resolution of 0.01 N, illustrated in FIG. 2. The as-spun ribbons of the alloy were cut in pieces by 45 mm in length and placed into flat grips as illustrated in FIG. 3. Gage length was kept constant at 4.8 mm. All tests were performed at room temperature and at constant strain rate of $1\times10^{-3}s^{-1}$. 5 to 6 tests were performed for every experimental point.

Figure 4:
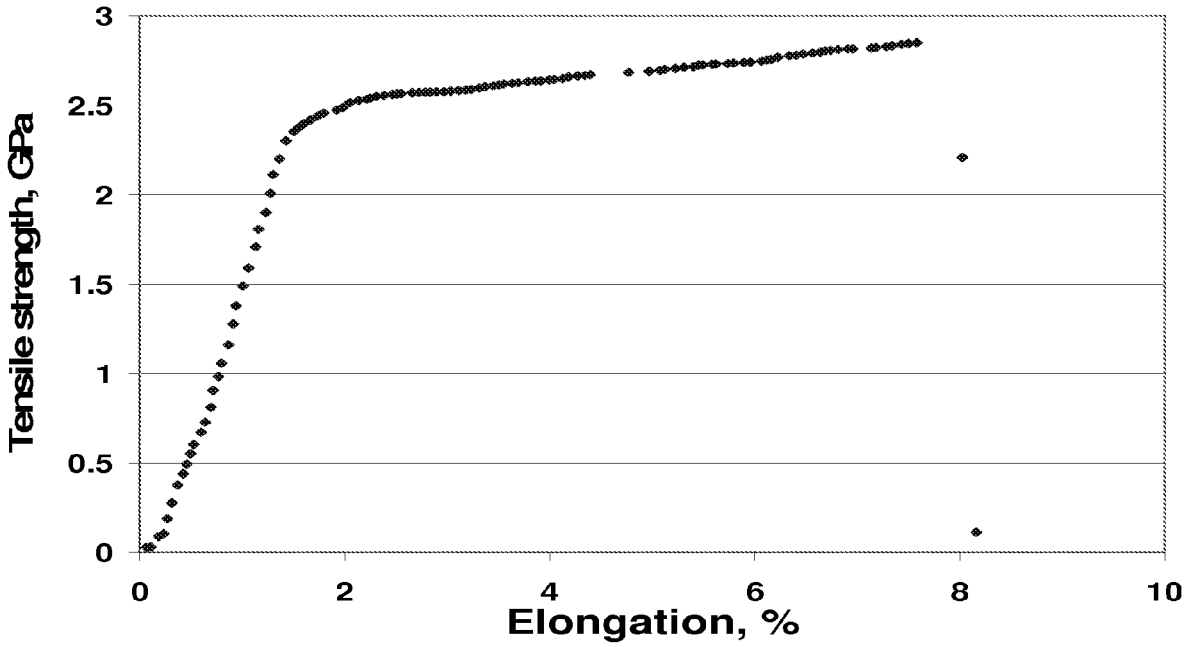
FIG. 4 Stress strain curves for the SHS7570 alloy showing 8% tensile elongation.
Figure 5:
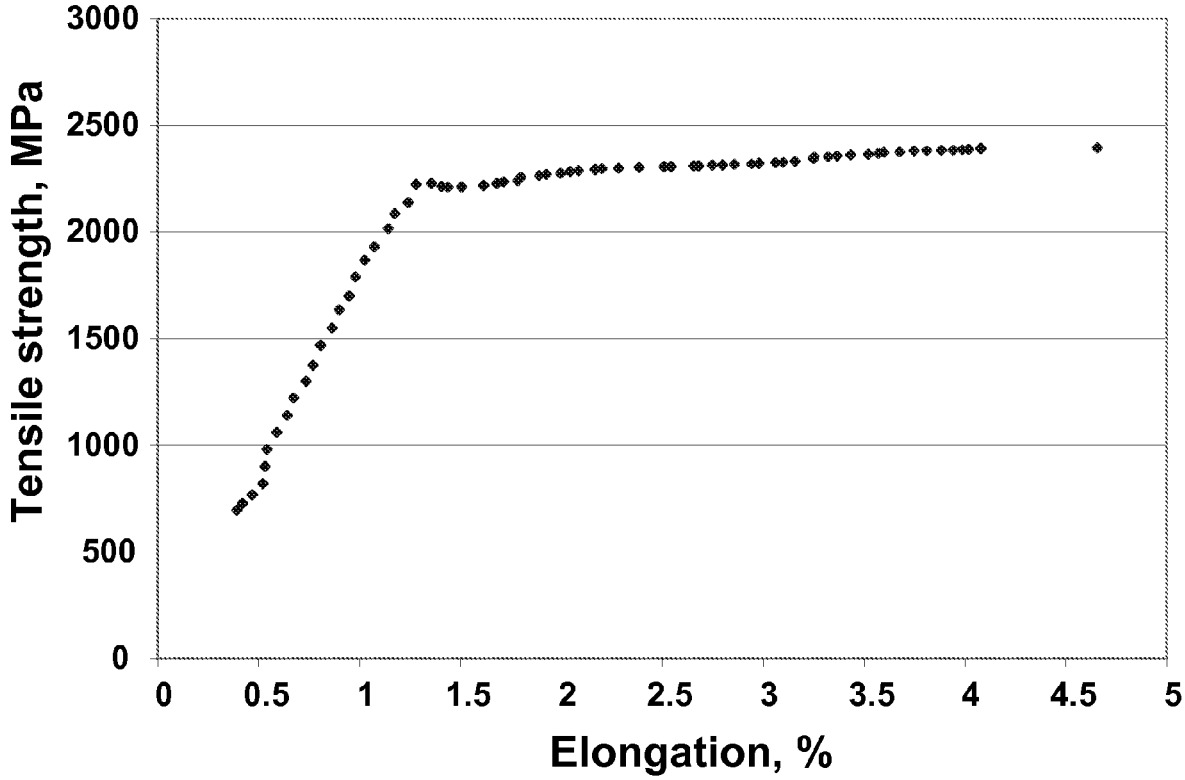
FIG. 5 Stress strain curves for the SHS7570 alloy showing 4% tensile elongation.

The tensile test results of the SHS7570 ribbon demonstrated relatively high elongation, which is illustrated in FIGS. 4 and 5. As shown in Table 1, in 2 tests out of 5, the alloy demonstrated an elongation from 4 to 8%.

TABLE 1

Tensile tests results on SHS7570 alloy

| Alloy | Tensile strength, MPa | Elongation |
|---|---|---|
| SHS7570 | 1510 | 0 |
| | 2403 | 4 |
| | 934 | 0 |
| | 2850 | 8 |
| | 500 | 0 |

Comparative Example 1

Figure 6:
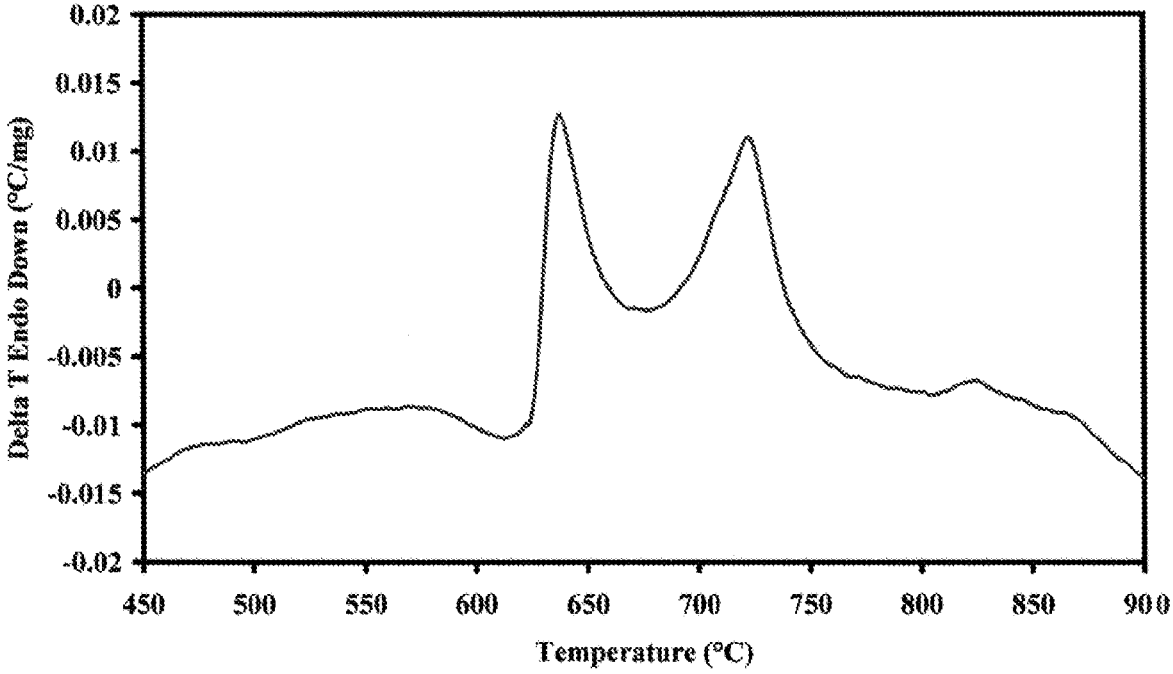
FIG. 6 illustrates a DTA curve of the melt-spun ribbon of SHS9570.
Figure 7:
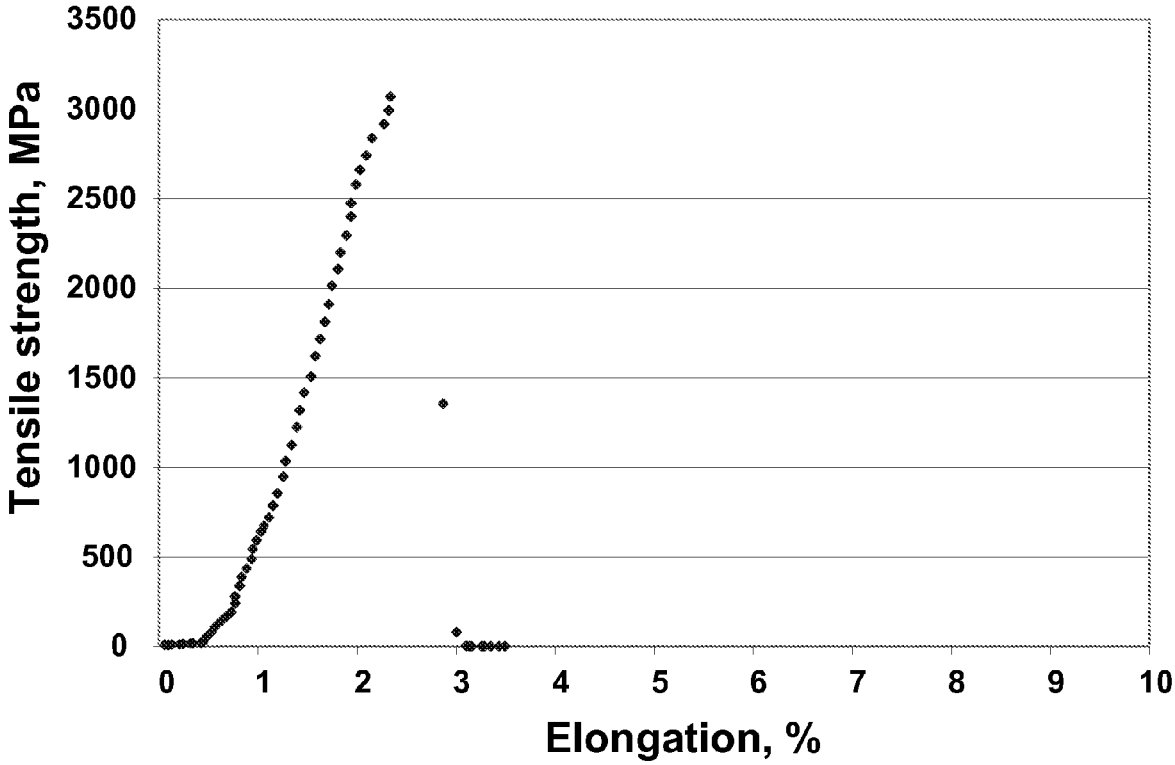
FIG. 7 illustrates a typical stress-strain curve for SHS9570 alloy.

Amorphous melt-spun ribbons of a wide range of iron based metallic glass alloys were observed. A DTA curve is shown of the melt-spun ribbon of SHS9570, available from NanoSteel Co., is illustrated in FIG. 6. The glass to crystalline transformation peaks are shown with peak temperatures at 637° C., 723° C., and 825° C. A typical stress-strain curve is shown in FIG. 7 for the SHS9570 alloy ($Fe_{50.8}Mn_{1.9}Cr_{18.4}Nb_{5.4}W_{1.7}B_{15.5}C_{3.9}Si_{2.4}$). The methodological procedure for testing was the same as described in Example 1.

Comparative Example 2

Maximum strength of ~6 GPa was previously observed in SHS7170, available from NanoSteel Co, having an alloy composition of Cr present at less than 20 at %, B present at less than 5 atomic %, W present at less than 10%, C present at less than 2%, Mo present at less than 5 atomic %, Si present at less than 2 atomic %, Mn present at less than 5% and the balance being iron. About 30 samples were tested and only one demonstrated the maximum strength of ~6 GPa.

Once again, without being limited to any particular theory, it appears that the scattering in tensile data may be due to sensitivity of metallic glasses to defects (metallurgical, geometrical, surface quality, etc.). According to literature results, in samples loaded in uni-axial tension (plane stress) at ambient temperatures, crack initiation and propagation occurs almost immediately after the formation of the first shear band, and as a result, metallic glasses tested under tension show essentially zero plastic strain prior to failure. Specimens loaded under constrained geometries (plane strain) may fail in an elastic, perfectly plastic manner by the generation of multiple shear bands. Multiple shear bands may also be observed when catastrophic instability is avoided via mechanical constraint, e.g., in uni-axial compression, bending, rolling, and under localized indentation. For example, a microscopic strain up to 2% has been found in different amorphous metals during compression testing. But even in this case, plasticity is typically in the order of 0.5-1%.

Devitrification of the metallic glasses may lead to brittle fracture at lower stresses despite the fact that, theoretically, nanocrystallized materials should be stronger (i.e. has been shown for some nanomaterial by compression tests). In general, nanomaterials produced by different methods may not show any plasticity at room temperature due to lack of mobility of dislocations. In general, strength of materials may be compensated by lack of ductility even for conventional material like high strength steel with ultimate strength of ~1900-2000 MPa and plasticity at break of ~2% only. Materials with higher strength, such as ceramics or special alloys may show 0% plasticity in tension.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A near metallic glass based alloy, comprising:

an alloy including Fe present in the range of 48 to 52 atomic %, Mn present in the range of 0.1 to 3.0 atomic %, Cr present in the range of 17 to 20 atomic %, Mo present in the range of 5 to 7 atomic %, W present in the range of 1 to 3 atomic %, B present in the range of 14 to 17 atomic %, C present in the range of 3 to 5 atomic percent and Si present in the range of 1 to 4 atomic % and said alloy exhibits a tensile strength of 2400 MPa or greater and an elongation of greater than 2%.

2. The near metallic glass based alloy of claim 1, wherein said alloy consists of Fe present in the range of 48 to 52 atomic %, Mn present in the range of 0.1 to 3.0 atomic %, Cr present in the range of 17 to 20 atomic %, Mo present in the range of 5 to 7 atomic %, W present in the range of 1 to 3 atomic %, B present in the range of 14 to 17 atomic %, C present in the range of 3 to 5 atomic percent and Si present in the range of 1 to 4 atomic %.

3. The near metallic glass based alloy of claim 1, wherein said alloy composition comprises $Fe_{50.8}Mn_{1.9}Cr_{18.4}Mo_{5.4}W_{1.7}B_{15.5}C_{3.9}Si_{2.4}$.

4. The near metallic glass based alloy of claim 1, wherein said alloys exhibit one or more crystallization transformation peaks at temperatures of greater than 625° C.

5. The near metallic glass based alloy of claim 1, wherein said alloy exhibits crystallization transformation peaks at temperatures in the range of 625° C. to 800° C.

6. The near metallic glass based alloy of claim 1, wherein said alloy exhibits elongation in the range of greater than 2% to 8%.

7. The near metallic glass based alloy of claim 1, wherein said alloy exhibits a tensile strength of 2400 to 2850 MPa.

* * * * *

UNITED STATES PATENT AND TRADEMARK OFFICE

CERTIFICATE OF CORRECTION

PATENT NO. : 8,062,436 B2
APPLICATION NO. : 12/268230
DATED : November 22, 2011
INVENTOR(S) : Daniel James Branagan et al.

It is certified that error appears in the above-identified patent and that said Letters Patent is hereby corrected as shown below:

On the Title Page, in Item (60), in Related U.S. Application Data, in column 1, line 2, delete "2001." and insert -- 2007. --, therefor.

Signed and Sealed this
Tenth Day of January, 2012

David J. Kappos

David J. Kappos
*Director of the United States Patent and Trademark Office*